United States Patent [19]

Degeye et al.

[11] 4,052,870

[45] Oct. 11, 1977

[54] BARREL HAVING TUMBLER PLATES FOR A CYLINDRICAL LOCK

[75] Inventors: Guy Degeye, Meru; Roger Filaine, Chaumont-en-Vexin, both of France

[73] Assignee: Paul Journee S.A., Courbevoie, France

[21] Appl. No.: 614,452

[22] Filed: Sept. 18, 1975

[30] Foreign Application Priority Data

Oct. 3, 1974 France ..... 74-33301

[51] Int. Cl.[2] ..... E05B 27/00

[52] U.S. Cl. ..... 70/364 R; 70/375

[58] Field of Search ..... 70/364 A, 364 R, 367, 70/368, 369, 373, 375, 377

[56] References Cited

U.S. PATENT DOCUMENTS

| | | | |
|---|---|---|---|
| 171,873 | 1/1876 | Shepardson | 70/364 R X |
| 1,565,558 | 12/1925 | Fremon | 70/375 |
| 1,644,092 | 10/1927 | Shinn | 70/364 R |
| 1,726,614 | 9/1929 | Falk | 70/364 R |
| 1,969,012 | 8/1934 | Jacobi | 70/375 X |
| 3,179,969 | 4/1965 | Glynn | 24/214 X |
| 3,209,568 | 10/1965 | Patriquin | 70/373 |
| 3,499,209 | 3/1970 | Laviana | 70/375 X |
| 3,702,553 | 11/1972 | Nolin | 70/375 |

FOREIGN PATENT DOCUMENTS

| | | | |
|---|---|---|---|
| 1,930,718 | 12/1970 | Germany | 70/377 |

*Primary Examiner*—Roy D. Frazier
*Assistant Examiner*—Peter A. Aschenbrenner
*Attorney, Agent, or Firm*—Nolte and Nolte

[57] ABSTRACT

A barrel having tumbler plates for a cylindrical lock, comprising a cylindrical body having a center cavity communicating laterally with two diametrally opposed regions of the body, and a core having slots carrying the tumbler plates and their return springs.

1 Claim, 7 Drawing Figures

BARREL HAVING TUMBLER PLATES FOR A CYLINDRICAL LOCK

The present invention relates to a barrel having tumbler plates for a cylindrical lock.

Tumbler plate barrels are usually constituted by a pressure-moulded body comprising transverse slots for the passage of the tumbler plates. The manufacture of these barrels, usually of zinc and aluminum alloy, is very difficult owing to their complexity and the necessary precision. This complexity moreover does not allow a simultaneous production of a large number of parts per unit of injection, which increases the cost and decreases output. The pressure moulding results in burrs or fins which must be removed by a costly burr-removing operation. Furthermore, these metal barrels are heavy and the mounting thereof in the lock with the positioning of the tumbler plates is a complicated operation difficult to render automatic.

Piston-type locks are known which comprise a hollow rotor in which there is mounted, by an axial sliding, a body carrying the pistons in order to be able to easily change the pistons and modify the combination of the lock (see U.S. Pat. No. 1,565,558). However, this method cannot be applied to tumbler plate-type locks. Moreover, disassembly of these known locks is, by design, easy, which of course renders the lock less safe.

An object of the invention is to avoid the drawbacks of known tumbler plate-type barrels by providing a new barrel in two parts which cannot be disassembled without extracting the barrel.

According to the invention, there is provided a barrel having tumbler plates for a cylindrical lock, the barrel comprising a cylindrical body having a centre cavity communicating laterally with two diametrally opposed regions of the body, and a core having slots carrying the tumbler plates and their return springs. With the barrel according to the invention, the body does not need to be of very high precision and the burrs need not be removed and the body may be manufactured with very cheap mass-production methods.

In a preferred embodiment, the body is of a pressure-moulded alloy and the core is of plastic material. The use of a plastic core reduces the weight of the barrel and permits this core to be manufactured with sufficient precision, which is much more easily achieved with plastic materials than with pressure-casting foundry methods. The lower strength of plastic materials is no drawback since the plates bear against receiving recesses in the fixed part (or stator) of the lock, which are of metal so that, in the event of an attempted interference with the lock, the mechanical resistance of the latter is the same as with the conventional locks.

In one embodiment, the centre cavity of the body has at least one ramp which terminates in a recess and the core has a complementary profile which terminates in a projection which clips in said recess at the end of the introduction of the core in the body. The assembly of the barrel is thus extremely simplified, the tumbler plates being previously mounted in the core. Preferably, the body and the core have positioning abutments.

The core has the usual slots for the sliding of the tumbler plates. The use of a plastic material permits a simple positioning of the tumbler plates and their spring after their introduction in their respective slots. For this purpose, according to one form of the invention, the slots in the core have an elastically yieldable boss which cooperates with a shoulder on the corresponding tumbler plate to maintain it in the slot.

The invention will be understood from the ensuing description with reference to the accompanying drawing in which FIG. 1 is an elevational view of a barrel according to one embodiment of the invention;

Figure 1:
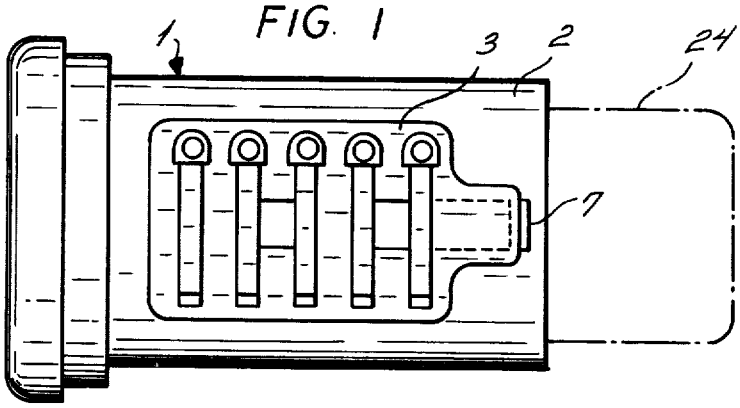
Figure 2:
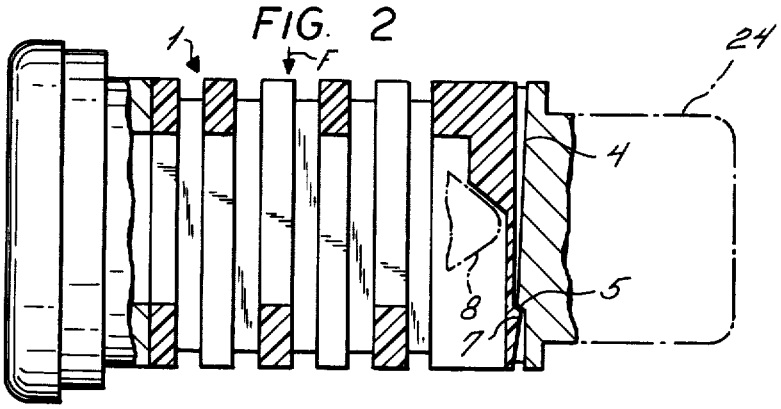
FIG. 2 is an elevational view, with a part cut away, of the barrel shown in FIG. 1.
Figure 3:
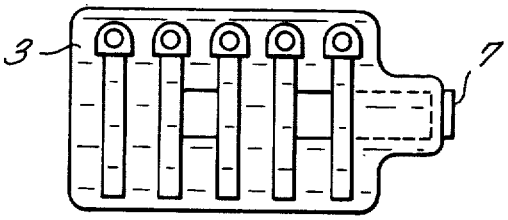
FIG. 3 is an elevational view of the core of the barrel shown in FIGS. 1 and 2.

FIGS. 1 and 2 show a composite barrel 1 according to the invention constituted by a body 2 and a core 3.

The front end 8 of a key has been shown partially in dotdash line in FIG. 2. The latter illustrates the clipping or engagement of the core 3, together with its tumbler plates 9 and its springs 6, at the end of its introduction in the body 2. The core is introduced by urging the latter in the direction of arrow F (FIGS. 2, 5, 6 and 7) against an abutment 14. At this moment, a projection 7 provided on the core 3 clips onto a shoulder 5 provided for this purpose in the body 2, by sliding along a ramp 4 provided on the body 2.

The support of the springs 6 of the tumbler plates 9 is achieved by abutment around conical studs 10 provided on the core 3.

Figure 4:
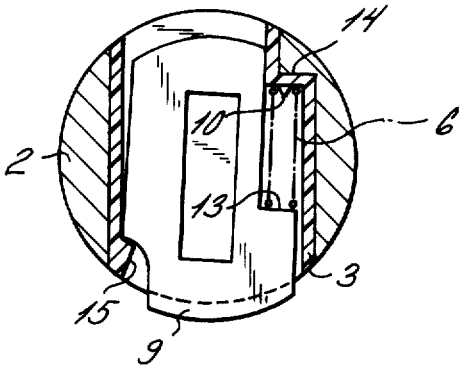
FIG. 4 is a cross-sectional view of the barrel in the region of a tumbler plate.

FIG. 4 shows a plate 9 introduced in the core 3 after assembly of the spring 6 between a centering stud 10 and the shoulder 13 of the tumbler plate 9, the final retention of the tumbler plate in its recess being achieved without forming over, by means of a boss 15.

This retention of the tumbler plates 9 inside the plastic core by the boss 15 is facilitated by the elasticity of the plastic material which resumes its initial position after a slight deformation at the moment of the introduction of the tumbler plate. When at the end of the assembly the core is finally inserted in the case or body, any accidental escape of the tumbler plates is impossible, the supporting body preventing any elastic deformation of the core.

The barrel 1 is extended in the known manner by a lower body portion which usually serves to drive another element and may have a variety of profiles (square, triangular, flatsided or some other profile).

Figure 5:
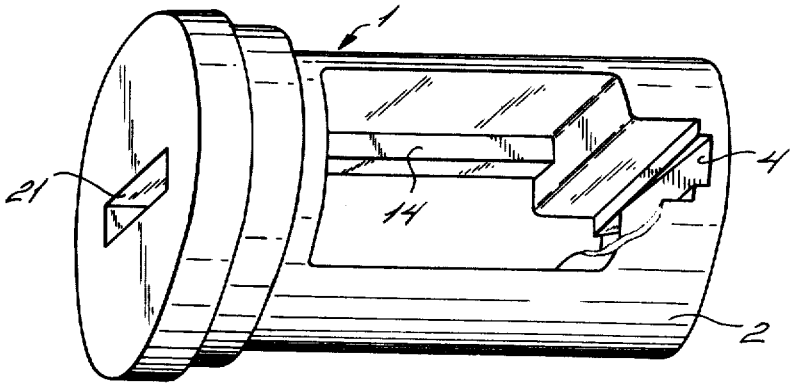
FIG. 5 is a perspective view of the body of the barrel.

FIG. 5 shows the opening 21 for the passage of the key and the abutment 14 which cooperates with a corresponding shoulder 14' of the core 3.

Figure 6:
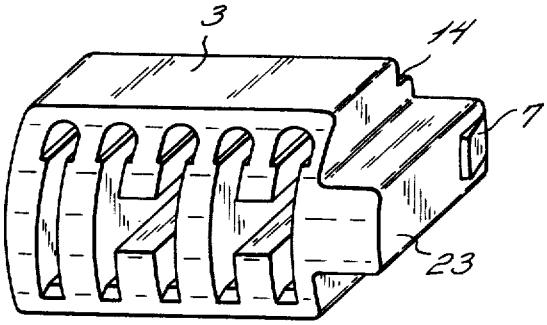
FIG. 6 is a perspective view of the core of the barrel.
Figure 7:
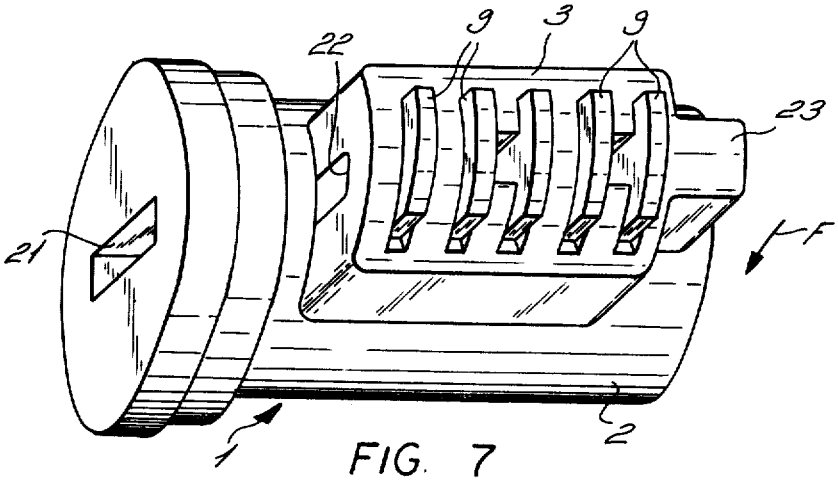
FIG. 7 is a perspective view of the barrel in the course of assembly.

FIG. 6 shows a preferred embodiment of the projection 7 or abutment having a ramp provided on the face of the front end 23 of the core 3.

What is claimed is:

1. A barrel having tumbler plates for a cylindrical lock, said barrel comprising a cylindrical body having a center cavity communicating laterally of the axis of the body with two diametrically opposed cylindrical surfaces of the body to form openings in said surfaces, and a core of plastic material insertable at one end of said center cavity and passing thereinto to occupy said cavity, and having a plurality of radial slots said slots registering with said openings, a plurality of tumbler plates each tumbler plate being received within a corresponding one of said slots and a plurality of return springs each one of which is associated with a corresponding one of said plates, each of said springs extending between an opposed shoulder of its associated tumbler plate and a shoulder within the slot within which the plate is located to bias the plate outwardly of the slot, a substantially rigid second shoulder on the plate facing in the direction in which the plate is biased by said spring, an elastically deflectable boss formed on a surface of said slot and defining a shoulder confronting said rigid shoulder of said plate whereby said plate is insertable into said slot only from that end towards which the plate is biased by the spring and only upon deflection of said boss and after insertion into slot is prevented from being removed by interengagement of said second shoulder of the plate and said shoulder of the boss, said center cavity of the body comprising at least one ramp extending from said one end of said cavity and which terminates in a shoulder and said core comprising a complementary profile which terminates in a projection which clips onto the shoulder of said ramp at the end of the introduction of said core into said body to prevent the removal of said core from said one end, a stop means within the cavity against which the core abuts when inserted to limit the extent to which said core can be inserted into said cavity from said one end.

* * * * *